US006293230B1

(12) United States Patent
Valcic et al.

(10) Patent No.: US 6,293,230 B1
(45) **Date of Patent: *Sep. 25, 2001**

(54) WATER HEATERS WITH FLAME TRAPS

(75) Inventors: Zoran Valcic, Chatswood; Geoffrey Mervyn Whitford, Dundas; Brendan Vincent Bourke, Gordon, all of (AU)

(73) Assignee: SRP 687 Pty Ltd. (AU)

( * ) Notice: Subject to any disclaimer, the term of this patent is extended or adjusted under 35 U.S.C. 154(b) by 0 days.

This patent is subject to a terminal disclaimer.

(21) Appl. No.: 09/175,026

(22) Filed: Oct. 20, 1998

(51) Int. Cl.[7] ..... F22B 5/00

(52) U.S. Cl. ..... 122/13.01; 122/14; 122/17; 122/18; 122/504; 126/42; 126/350 R

(58) Field of Search ..... 122/13.01, 14.22, 122/17.1, 18.3; 126/42; 431/346, 22, 354

(56) References Cited

U.S. PATENT DOCUMENTS

| | | |
|---|---|---|
| 360,199 | 3/1887 | Boegler . |
| 626,454 | 6/1899 | Brintnall . |
| 0,736,153 | 8/1903 | Reynolds . |
| 796,924 | 8/1905 | McCartney . |
| 1,398,986 | 12/1921 | Warnock . |
| 1,661,193 | 3/1928 | Newport . |
| 1,692,839 | 11/1928 | Humphrey . |
| 1,806,216 | 5/1931 | Plummer . |
| 1,841,463 | 1/1932 | Barber et al. . |
| 2,008,155 | 7/1935 | Ramsdell et al. . |
| 2,036,136 | 3/1936 | Guarcello . |
| 2,070,535 | 2/1937 | Hansen . |
| 2,112,655 | 3/1938 | Morrow . |
| 2,429,916 | 10/1947 | Belgau . |
| 2,479,042 | 8/1949 | Gaines . |
| 2,499,636 | 3/1950 | Finley . |
| 2,559,110 | 7/1951 | Burwell . |
| 3,139,067 | 6/1964 | Van Den Broek et al. . |
| 3,161,227 | 12/1964 | Goss et al. . |
| 3,741,166 | 6/1973 | Bailey . |
| 3,920,375 | 11/1975 | Sanderson et al. . |
| 3,947,229 | 3/1976 | Richter . |
| 4,039,272 | 8/1977 | Elliot . |
| 4,080,149 * | 3/1978 | Wolfe ..... 431/1 |
| 4,177,168 | 12/1979 | Denny et al. . |

(List continued on next page.)

FOREIGN PATENT DOCUMENTS

| | | |
|---|---|---|
| 25 40 709 A 1 | 3/1977 | (DE) . |
| 39 26 699 A 1 | 2/1991 | (DE) . |
| 41 14 620 A1 | 10/1991 | (DE) . |
| 297 10 385 U1 | 10/1997 | (DE) . |
| 0 055 424 A1 | 7/1982 | (EP) . |
| 0 544 199 A1 | 6/1993 | (EP) . |
| 0 560 419 A2 | 9/1993 | (EP) . |
| 0 596 555 A1 | 5/1994 | (EP) . |
| 0 657 691 A1 | 6/1995 | (EP) . |
| 60-134117 | 7/1985 | (JP) . |
| 62-162814 | 7/1987 | (JP) . |
| 470 252 | 12/1993 | (SE) . |
| WO 94/00197 | 1/1994 | (WO) . |
| WO 94/01722 | 1/1994 | (WO) . |

OTHER PUBLICATIONS

"Flame Traps—a Technical Note" Journal of Mines, Metals & Fuels, Jul. 1987.

*Primary Examiner*—John A. Jeffery
*Assistant Examiner*—Jiping Lu
(74) *Attorney, Agent, or Firm*—Schnader, Harrison, Segal & Lewis, LLP

(57) ABSTRACT

A gas water heater including a water container adapted to be heated by a gas burner; and an enclosure surrounding the burner, the enclosure having at least one entryway adapted to allow air and fumes to enter the enclosure without igniting flammable gases or vapors outside of the enclosure.

20 Claims, 11 Drawing Sheets

(4 of 11 Drawing Sheet(s) Filed in Color)

U.S. PATENT DOCUMENTS

| | | |
|---|---|---|
| 4,191,173 | 3/1980 | Dedeian et al. . |
| 4,204,833 | 5/1980 | Kmetz et al. . |
| 4,241,723 | 12/1980 | Kitchen . |
| 4,510,890 | 4/1985 | Cowan . |
| 4,519,770 | 5/1985 | Kesselring et al. . |
| 4,639,213 | 1/1987 | Simpson . |
| 4,641,631 | 2/1987 | Jatana . |
| 4,742,800 | 5/1988 | Eising . |
| 4,777,933 | 10/1988 | Ruark . |
| 4,790,268 | 12/1988 | Eising . |
| 4,817,564 | 4/1989 | Akkala et al. . |
| 4,823,770 | 4/1989 | Loeffler . |
| 4,863,370 | 9/1989 | Yokoyama et al. . |
| 4,869,232 | 9/1989 | Narang . |
| 4,872,443 | 10/1989 | Ruark . |
| 4,893,609 | 1/1990 | Giordani et al. . |
| 4,919,085 | 4/1990 | Ishiguro . |
| 4,924,816 | 5/1990 | Moore, Jr. et al. . |
| 4,960,078 | 10/1990 | Yokoyama et al. . |
| 5,020,512 | 6/1991 | Vago et al. . |
| 5,044,928 | 9/1991 | Yokoyama et al. . |
| 5,085,205 | 2/1992 | Hall et al. . |
| 5,197,456 | 3/1993 | Ryno . |
| 5,205,731 | 4/1993 | Reuther et al. . |
| 5,215,457 | 6/1993 | Sebastiani . |
| 5,240,411 | 8/1993 | Abalos . |
| 5,246,397 | 9/1993 | Petter . |
| 5,261,438 | 11/1993 | Katchka . |
| 5,317,992 | 6/1994 | Joyce . |
| 5,355,841 | 10/1994 | Moore, Jr. et al. . |
| 5,368,263 | 11/1994 | Harrison . |
| 5,385,467 | 1/1995 | Sebastiani et al. . |
| 5,397,233 | 3/1995 | Eavenson et al. . |
| 5,427,525 | 6/1995 | Shukla et al. . |
| 5,435,716 | 7/1995 | Joyce . |
| 5,448,969 | 9/1995 | Stuart et al. . |
| 5,494,003 | 2/1996 | Bartz et al. . |
| 5,511,516 | 4/1996 | Moore, Jr. et al. . |
| 5,520,536 | 5/1996 | Rodgers et al. . |
| 5,522,723 | 6/1996 | Durst et al. . |
| 5,531,214 | 7/1996 | Cheek . |
| 5,533,495 | 7/1996 | Moore, Jr. . |
| 5,556,272 | 9/1996 | Blasko et al. . |
| 5,575,274 | 11/1996 | DePalma . |
| 5,588,822 | 12/1996 | Hayakawa et al. . |
| 5,649,821 | 7/1997 | Fogliani et al. . |
| 5,674,065 | 10/1997 | Grando et al. . |
| 5,791,298 | 8/1998 | Rodgers . |
| 5,797,355 | 8/1998 | Bourke et al. . |
| 5,797,358 | 8/1998 | Brandt et al. . |
| 5,937,796 | 8/1999 | Sebastiani . |
| 5,941,200 | 8/1999 | Boros et al. . |

* cited by examiner

WATER HEATERS WITH FLAME TRAPS

FIELD OF INVENTION

The present invention relates to air inlets/flame traps for water heaters, particularly to improvements to gas fired water heaters adapted to tender them safer for use.

BACKGROUND

The most commonly used gas-fired water heater is the storage type, generally comprising an assembly of a water tank, a main burner to provide heat to the tank, a pilot burner to initiate the main burner on demand, an air inlet adjacent the burner near the base of the jacket, an exhaust flue and a jacket to cover these components. Another type of gas-fired water heater is the instantaneous type which has a water flow path through a heat exchanger heated, again, by a main burner initiated from a pilot burner flame.

For convenience, the following description is in terms of storage type water heaters but the invention is not limited to this type. Thus, reference to "water container," "water containment and flow means, " "means for storing or containing water" and similar such terms includes water tanks, reservoirs, bladders, bags and the like in gas-fired water heaters of the storage type and water flow paths such as pipes, tubes, conduits, heat exchangers and the like in gas-fired water heaters of the instantaneous type.

A particular difficulty with many locations for water heaters is that the locations are also used for storage of other equipment such as lawn mowers, trimmers, snow blowers and the like. It is a common procedure for such machinery to be refueled in such locations.

There have been a number of reported instances of spilled gasoline and associated extraneous fumes being accidentally ignited. There are many available ignition sources, such as refrigerators, running engines, electric motors, electric and gas dryers, electric light switches and the like. However, gas water heaters have sometimes been suspected because they often have a pilot flame.

Vapors from spilled or escaping flammable liquid or gaseous substances in a space in which an ignition source is present provides for ignition potential. "Extraneous fumes," "fumes" or "extraneous gases" are sometimes hereinafter used to encompass gases, vapors or fumes generated by a wide variety of liquid volatile or semi-volatile substances such as gasoline, kerosene, turpentine, alcohols, insect repellent, weed killer, solvents and the like as well as non-liquid substances such as propane, methane, butane and the like.

Many inter-related factors influence whether a particular fuel spillage leads to ignition. These factors include, among other things, the quantity, nature and physical properties of the particular type of spilled fuel. Also influential is whether air currents in the room, either natural or artificially created, are sufficient to accelerate the spread of fumes, both laterally and in height, from the spillage point to an ignition point yet not so strong as to ventilate such fumes harmlessly, that is, such that air to fuel ratio ranges are capable of enabling ignition are not reached given all the surrounding circumstances.

One surrounding circumstance is the relative density of the fumes. When a spilled liquid fuel spreads on a floor, normal evaporation occurs and fumes from the liquid form a mixture with the surrounding air that may, at some time and at some locations, be within the range that will ignite. For example, the range for common gasoline vapor is between about 2% and 8% gasoline with air, for butane between 1% and 10%. Such mixtures form and spread by a combination of processes including natural diffusion, forced convection due to air current drafts and by gravitationally affected upward displacement of molecules of one less dense gas or vapor by those of another more dense. Most common fuels stored in households are, as used, either gases with densities relatively close to that of air (eg. propane and butane) or liquids which form fumes having a density close to that of air, (eg. gasoline, which may contain butane and pentane among other components is very typical of such a liquid fuel).

In reconstructions of accidental ignition situations, and when gas water heaters are sometimes suspected and which involved spilled fuels typically used around households, it is reported that the spillage is sometimes at floor level and, it is reasoned, that it spreads outwardly from the spill at first close to floor level. Without appreciable forced mixing, the air/fuel mixture would tend to be at its most flammable levels close to floor level for a longer period before it would slowly diffuse towards the ceiling of the room space. The principal reason for this observation is that the density of fumes typically involved is not greatly dissimilar to that of air. Combined with the tendency of ignitable concentrations of the fumes being at or near floor level is the fact that many gas appliances often have their source of ignition at or near that level.

The invention aims to substantially raise the probability of successful confinement of ignition of spilled flammable substances from typical spillage situations to the inside of the combustion chamber.

SUMMARY OF THE INVENTION

The invention relates to a water heater including a water container and a combustion chamber adjacent the container. The combustion chamber has at least one flame trap to admit air and extraneous fumes into the combustion chamber. The flame trap (also referred to as an "air inlet") has a plurality of ports. The ports are sized and shaped to cause air and extraneous fumes to pass through the ports at a velocity higher than the flame velocity of the extraneous fumes, thereby confining ignition and combustion of the extraneous fume species within the combustion chamber. The water heater also includes a burner associated with the combustion chamber and arranged to combust fuel to heat water in the container.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

DETAILED DESCRIPTION OF THE INVENTION

Figure 1:
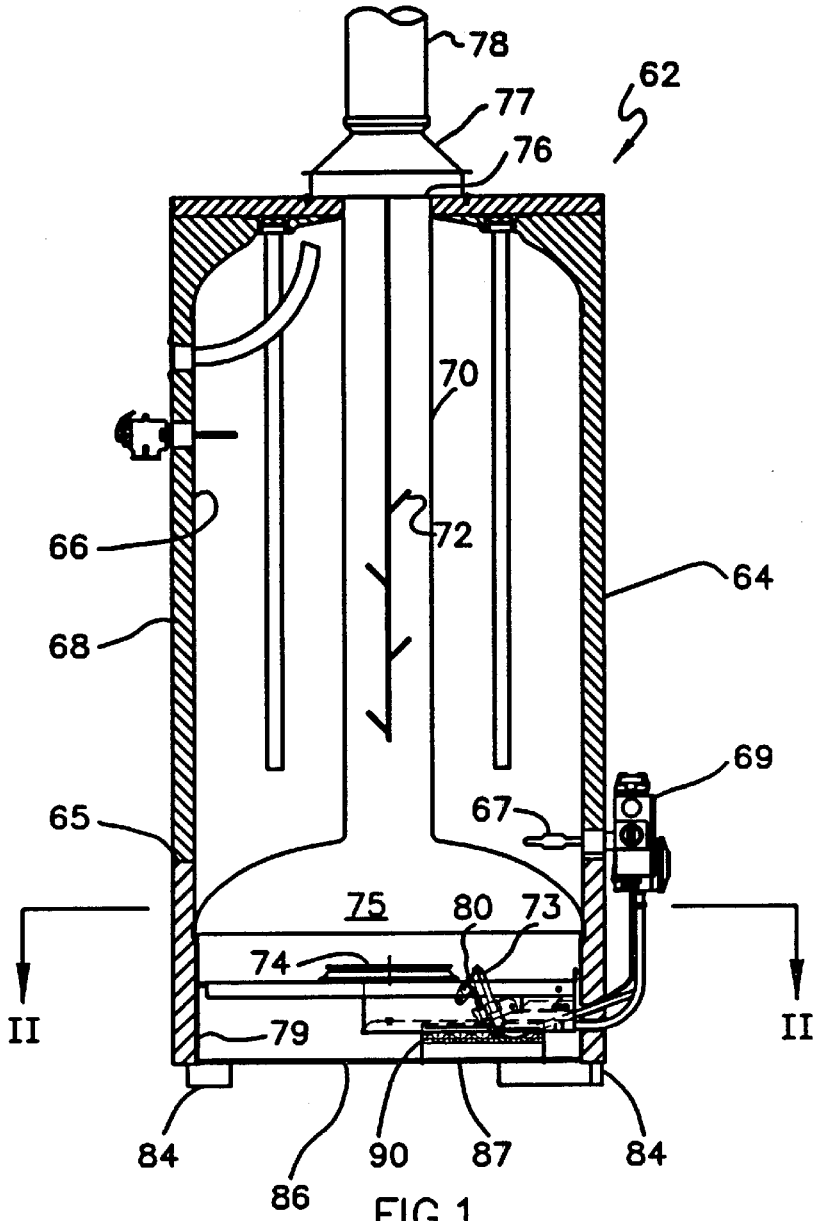
FIG. 1 is a schematic partial cross-sectional view of a gas-fueled water heater having a single air inlet according to the invention.

It will be appreciated that the following description is intended to refer to the specific embodiments of the invention selected for illustration in the drawings and is not intended to limit or define the invention, other than in the appended claims.

Figure 2:
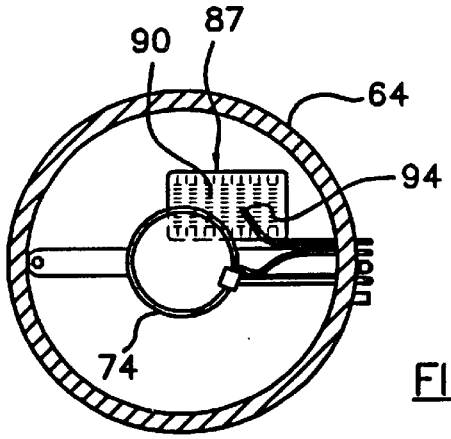
FIG. 2 is a cross-sectional view of a water heater taken through the line II—II in FIG. 1.

Turning now to the drawings in general and FIGS. 1 and 2 in particular, there is illustrated a storage type gas water heater 62 including jacket 64 which surrounds a water tank 66 and a main burner 74 in an enclosed chamber 75 that addresses and solves the long-standing problems described above. Water tank 66 is preferably capable of holding heated water at mains pressure and is insulated preferably by foam insulation 68. Alternative insulation may include fiberglass or other types of fibrous insulation and the like. Fiberglass insulation surrounds chamber 75 at the lowermost portion of water tank 66. It is possible that heat resistant foam insulation can be used if desired. A foam dam 67 separates foam insulation 68 and the fiberglass insulation.

Located underneath water tank 66 is a pilot burner 73 and main burner 74 which preferably use natural gas as fuel or other gases such as LPG, for example. Other suitable fuels may be substituted. Burners 73 and 74 combust gas admixed with air and the hot products of combustion rise up through flue 70, possibly with heated air. Water tank 66 is lined with a glass coating for corrosion resistance. The thickness of the coating on the exterior surface of water tank 66 is about one half of the thickness of the interior facing surface to prevent "fish scaling". Also, the lower portion of flue 70 is coated to prevent scaling that could fall into chamber 75 and possibly partially block off the air inlet plate 90.

The fuel gas is supplied to both burners (73, 74) through a gas valve 69. Flue 70 in this instance, contains a series of baffles 72 to better transfer heat generated by main burner 74 to water within tank 66. Near pilot burner 73 is a flame detecting thermocouple 80 which is a known safety measure to ensure that in the absence of a flame at pilot burner 73 the gas control valve 69 shuts off the gas supply. The water temperature sensor 67, preferably located inside the tank 66, co-operates also with the gas control valve 69 to supply gas to the main burner 74 on demand.

The products of combustion pass upwardly and out the top of jacket 64 via flue outlet 76 after heat has been transferred from the products of combustion. Flue outlet 76 discharges conventionally into a draught diverter 77 which in turn connects to an exhaust duct 78 leading outdoors.

Water heater 62 is mounted preferably on legs 84 to raise the base 86 of the combustion chamber 75 off the floor. In base 86 is an aperture 87 which is closed gas tightly by an air inlet plate 90 which admits all required air for the combustion of the fuel gas combusted through the main burner 74 and pilot burner 73, regardless of the relative proportions of primary and secondary combustion air used by each burner. Air inlet plate 90 is preferably made from a thin metallic perforated sheet of stainless steel.

Where base 86 meets the vertical combustion chamber walls 79, adjoining surfaces can be either one piece or alternatively sealed thoroughly to prevent ingress of air or flammable extraneous fumes. Gas, water, electrical, control or other connections, fittings or plumbing, wherever they pass through combustion chamber wall 79 are sealed. The combustion chamber 75 is air/gas tight except for means to supply combustion air and to exhaust combustion products through flue 70.

Pilot flame establishment can be achieved by a piezoelectric igniter. A pilot flame observation window can be provided which is sealed. Cold water is introduced at a low level of the tank 66 and withdrawn from a high level in any manner as already well known.

During normal operation, water heater 62 operates in substantially the same fashion as conventional water heaters except that all air for combustion enters through air inlet plate 90. However, if spilled fuel or other flammable fluid is in the vicinity of water heater 62 then some extraneous fumes from the spilled substance may be drawn through plate 90 by virtue of the natural draft characteristic of such water heaters. Air inlet 90 allows the combustible extraneous fumes and air to enter but confines potential ignition and combustion inside the combustion chamber 75.

The spilled substance is burned within combustion chamber 75 and exhausted through flue 70 via outlet 76 and duct 79. Because flame is confined by the air inlet plate 90 within the combustion chamber, flammable substance external to water heater 62 will not be ignited.

As best seen in FIG. 2, the inlet plate has mounted on or adjacent its upward facing surface a thermally sensitive fuse 94 in series in an electrical circuit with pilot flame proving thermocouple 80 and a solenoid coil in gas valve 69 (FIG. 1).

With reference to FIG. 1, the size of air inlet plate 90 is dependent upon the air consumption requirement for proper combustion to meet mandated specifications to ensure low pollution burning of the gas fuel. Merely by way of general indication, the air inlet plate of FIG. 1 should be conveniently about 3700 $mm_2$ perforated area when fitted to a water heater having between 35,000 and 50,000 Btu/hr (approximate) energy consumption rating to meet ANSI requirements for overload combustion.

Figure 3:
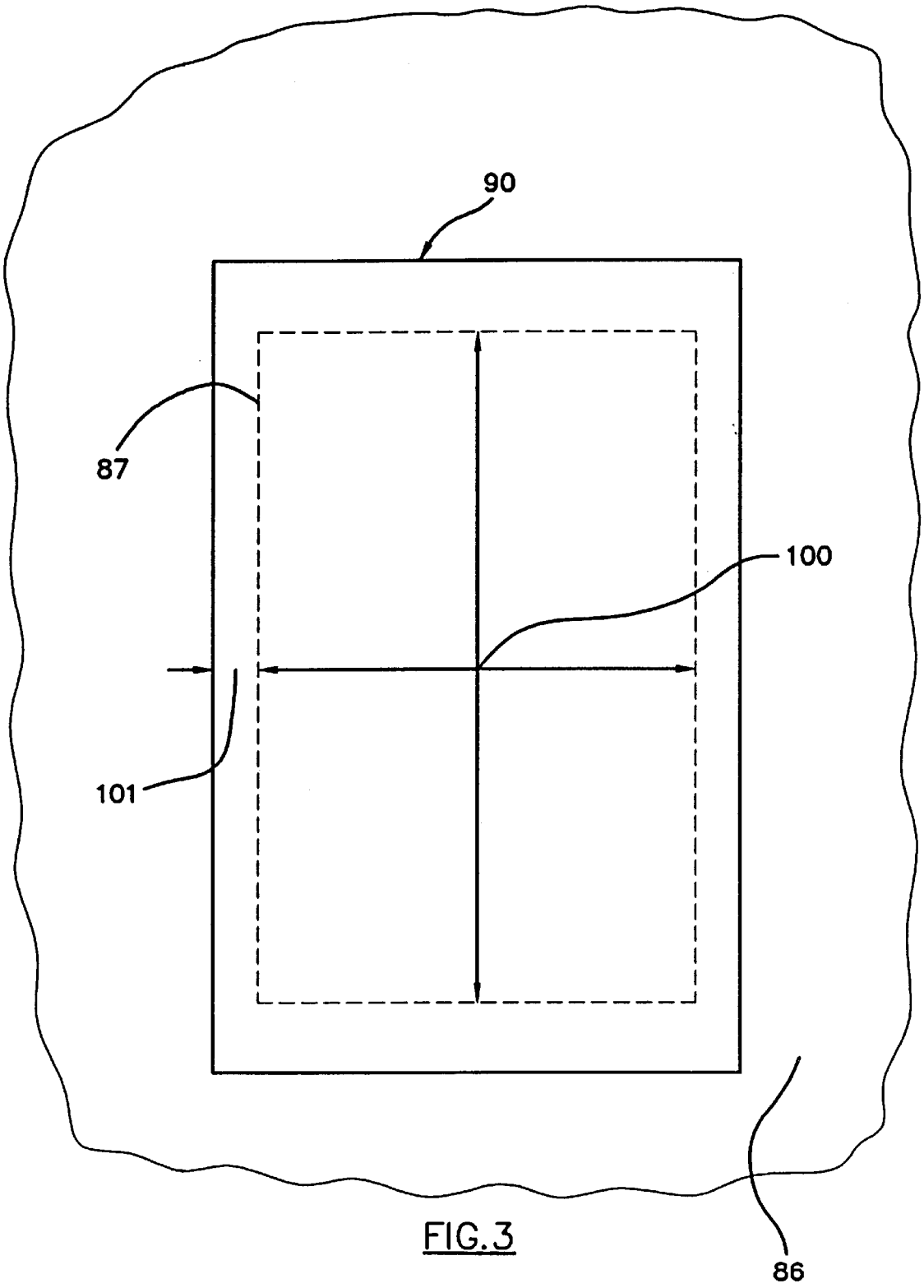
FIG. 3 is a schematic plan view depicting a portion of the base of a combustion chamber of a water heater including an air inlet.

FIG. 3 shows schematically an air inlet to a sealed combustion chamber comprising an aperture 87 in the lower wall 86 of the combustion chamber and a thin sheet metal air inlet plate 90 having a perforated area 100 and an unperforated border or flange 101.

Holes in the perforated area 100 of plate 90 can be circular or other shape although slotted holes have certain advantages as will be explained, the following description referring to slots.

Figure 4:
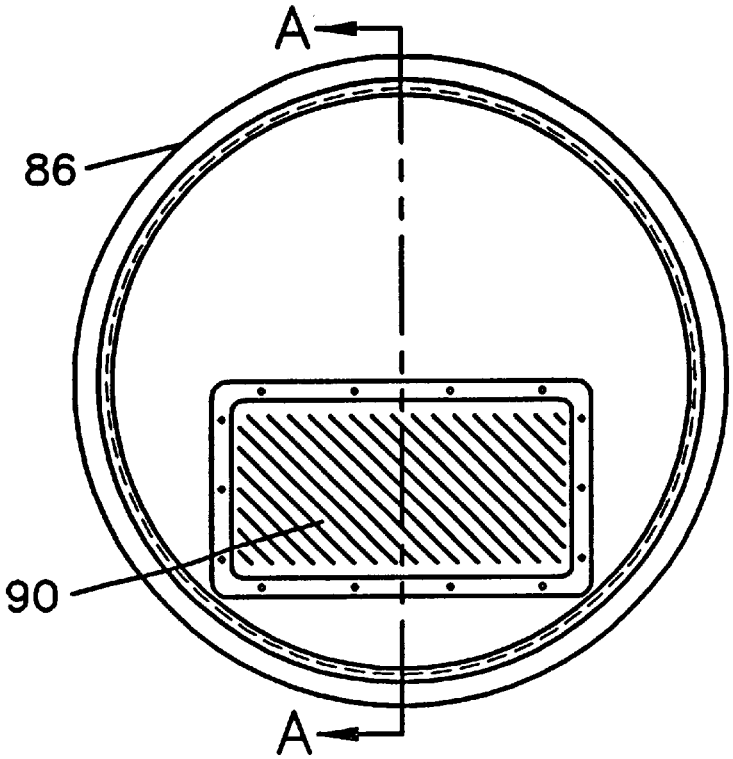
FIG. 4 is an enlarged schematic plan view of an air inlet shown in FIG. 2 with the burner and fuel supply apparatus removed for ease of understanding.
Figure 5:
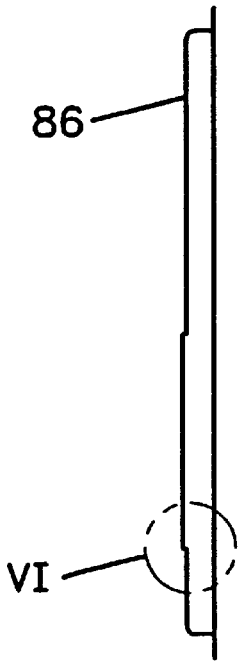
FIG. 5 is a cross-sectional view taken through the line A—A of FIG. 4.
Figure 6:
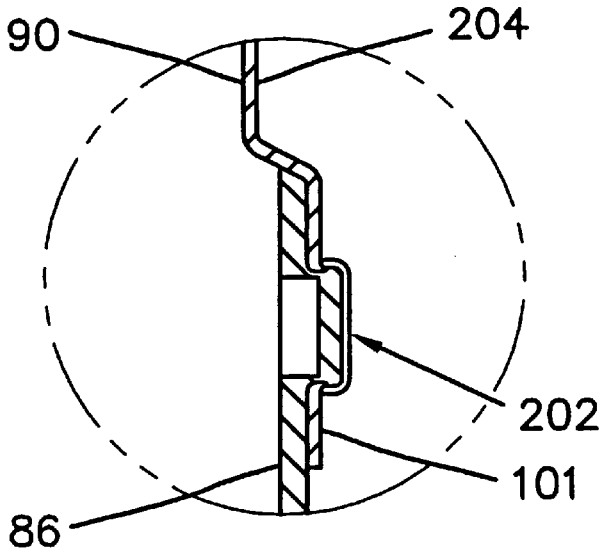
FIG. 6 is an exploded view of an air inlet/bottom pan mechanical crimp.

FIGS. 4–6 show a preferred arrangement of air inlet 90 with respect to lower wall 86 of the combustion chamber and the manner in which air inlet 90 is fixed or sealed to that lower wall 86.

It is intended that inlet 90 be substantially sealed against lower wall 86 to prevent air and/or extraneous fumes to pass between facing surfaces of inlet 90 and lower wall 86. Inlet 90 has an outer flange 101 that extends beyond the edge of the opening in lower wall 86. Periodically, along flange 101, mechanical crimps 202 are "pressed" into flange 101 and the corresponding portion of lower wall 86. Such crimps 202 are well known in the sheet metal fabrication art, TOG-L-LOC® crimps being a particularly preferred example. Other means of securing or fixing air inlet 90 to lower wall 86 are possible, spot welding being one example.

Inlet 90 also has a raised portion 204 that extends above the upper surface of lower wall 86. This assists in ensuring that condensation generated in flue tube 70 does not lie or congregate on inlet 90 so as to occlude the openings/slots therein.

Figure 7:
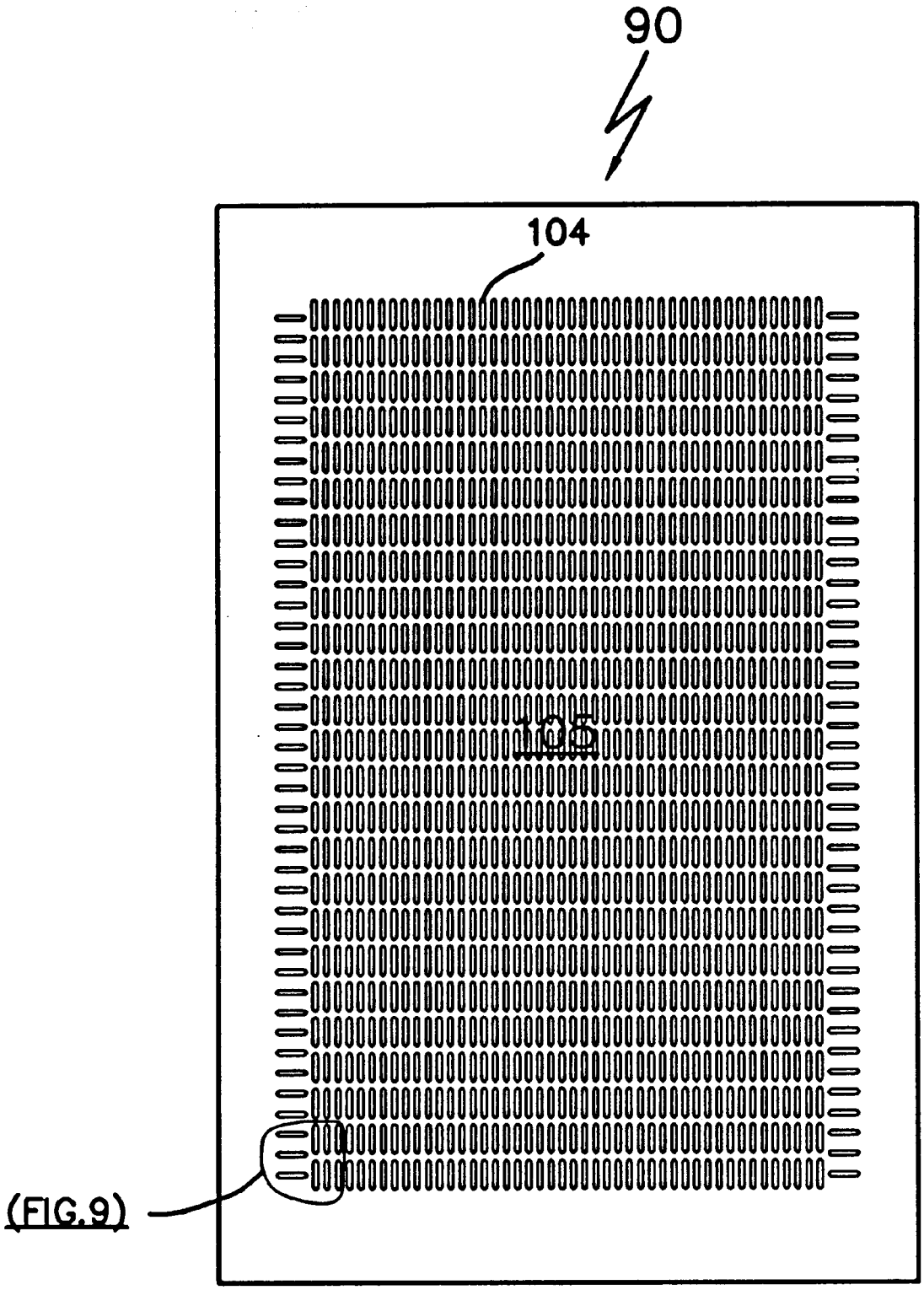
FIG. 7 shows a top plan view of a preferred air inlet of the invention.

FIG. 7 shows an air inlet plate 90 as will be described to admit air to the combustion chamber 75. The air inlet plate 90 is a thin sheet metal plate having many small slots 104 passing through it. The metal may be stainless steel having a nominal thickness of about 0.5 mm although other metals such as copper, brass, mild steel and aluminum and thicknesses in the range of about 0.3 mm to about 1 mm as an indication, are suitable. Depending on the metal and its mechanical properties, the thickness can be adjusted within the suggested range. Grade 309 and 316 stainless steel, having a thickness of 0.45 mm to 0.55 mm are preferred for blanked or photochemically machined plates 90.

FIG. 7 is a plan view of an air inlet plate having a series of ports in the shape of slots 104 aligned in rows. All such slots 104 have their longitudinal axes parallel except for the edge slots 107 at right angles to those of the ports 104 in the remaining perforated area 105. Another preferred pattern, not shown, omits edge slots 107. The ports are arranged in a rectangular pattern formed by the aligned rows. The plate is most preferably about 0.5 millimeters thick. This provides inlet plate 90 with adequate damage resistance and, in all other aspects, operates effectively. The total cross-sectional area of the slots 104 is selected on the basis of the flow rate of air required to pass through the inlet plate 90 during normal and overload combustion. For example, a gas fired water heater rated at 50,000 BTU/hour requires at least 3,500 to 4,000 square millimeters of port space in plates of nominal thickness 0.5 mm.

The slots 104 are provided to allow sufficient combustion air through the inlet plate 90 and there is no exact restriction on the total number of slots 104 or total area of the plate, both of which are determined by the capacity of a chosen gas (or fuel) burner to generate heat by combustion of a suitable quantity of gas with the required quantity of air to ensure complete combustion in the combustion chamber and the size and spacing of the slots 104. The air for combustion passes through the slots and not through any larger inlet air passage or passages to the combustion chamber. No such larger inlet is provided.

The water heater of the invention thus includes a water container and a combustion chamber adjacent to the container. The combustion chamber has at least one inlet to admit air and extraneous fume species into the combustion chamber. The inlet has a plurality of ports, the ports being sized and shaped to confine ignition and combustion of the extraneous fume species within the combustion chamber. "Sized and shaped" includes at least shapes such as slots, circles, rectangles and the like, dimensions in the X-Y plane and dimensions in the Z plane, i.e. thickness, wall orientation such as parallel, nonparallel and the like, and port distances. The water heater also includes a burner associated with the combustion chamber and arranged to combust fuel to heat water in the container.

Figure 8:
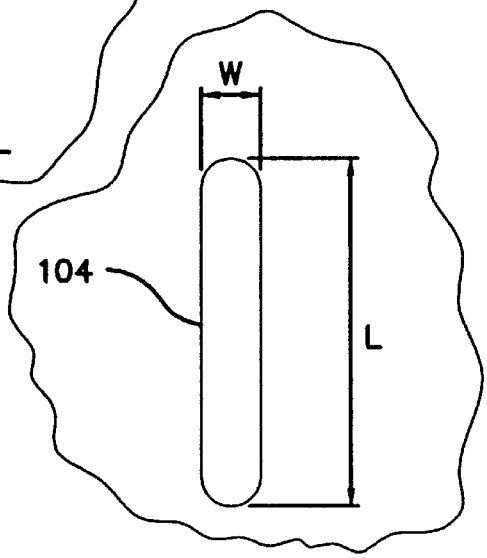
FIG. 8 illustrates a plan view of a single port taken from the air inlet shown in FIG. 7.
Figure 11:
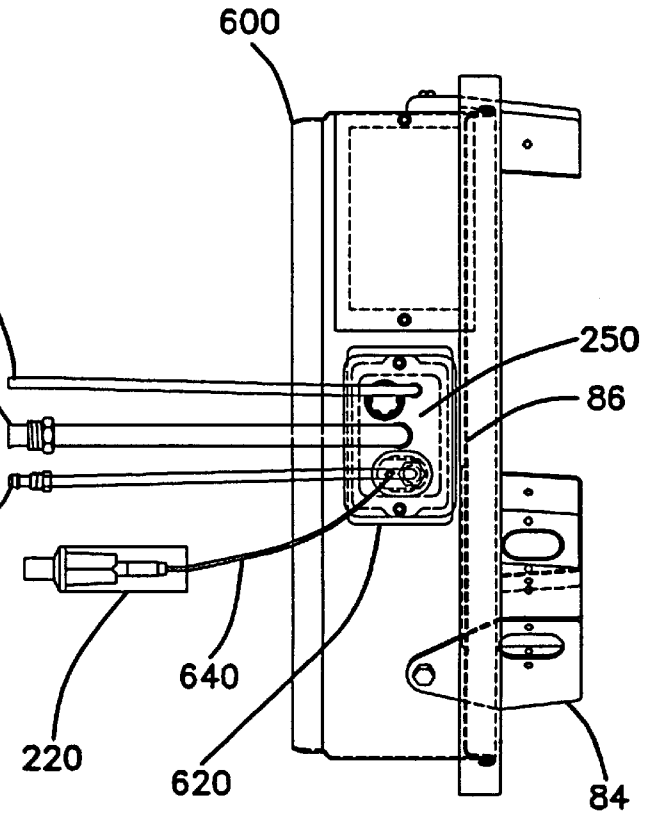
FIG. 11 is a side view of the structure illustrated in FIG. 10 rotated by 90°.
Figure 10:
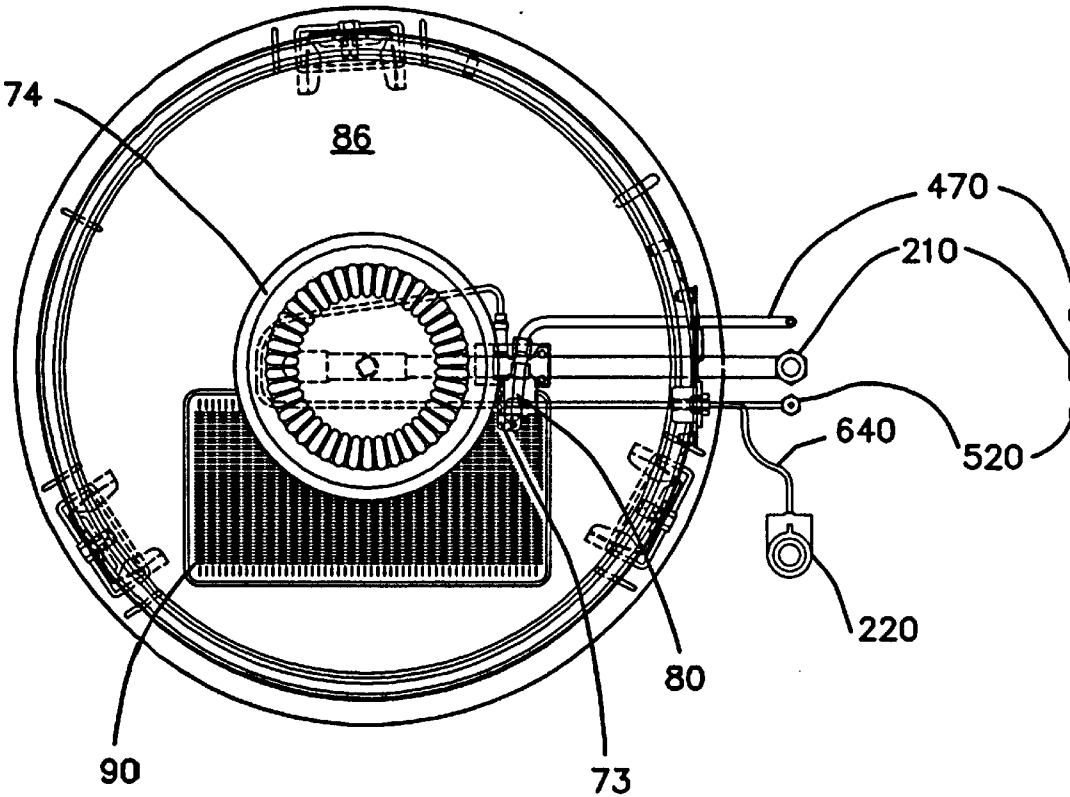
FIG. 10 is a top plan view of a main burner, pilot burner, thermocouple and air inlet arrangement in a combustion chamber of an especially preferred embodiment of the invention.
Figure 12:
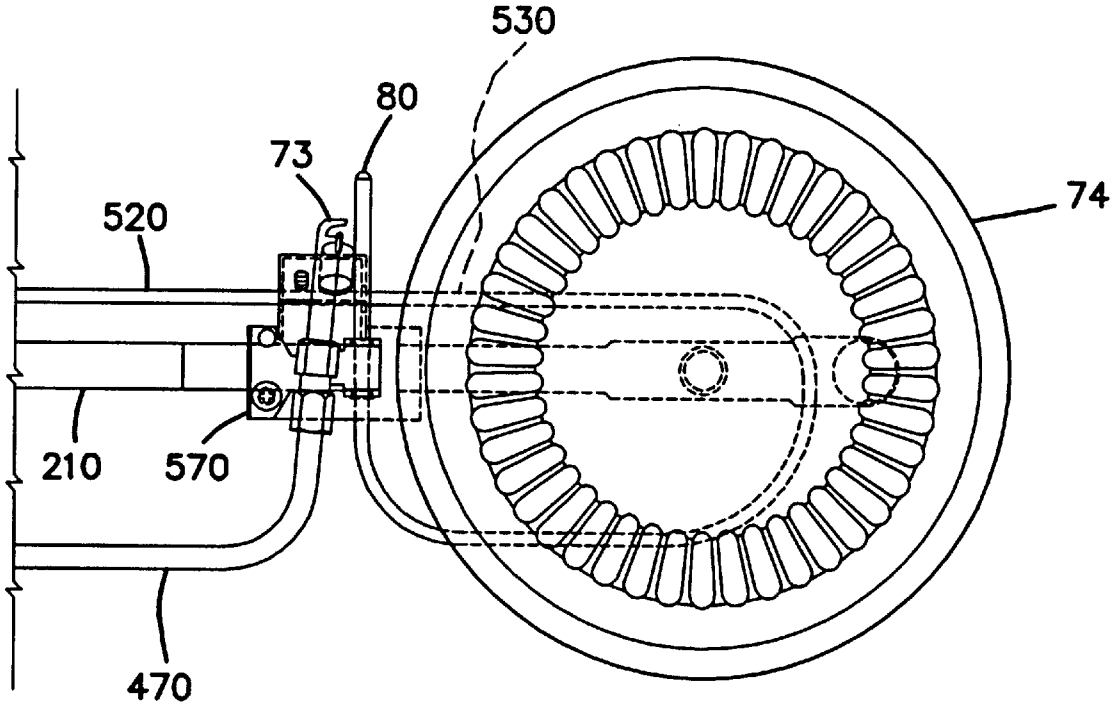
FIG. 12 is an exploded view of the main burner, pilot burner and thermocouple arrangement shown in FIG. 10.
Figure 13:
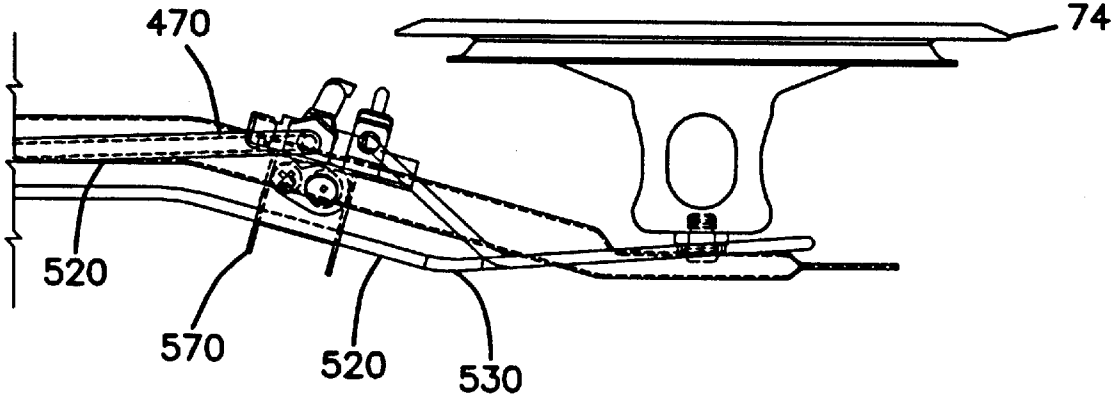
FIG. 13 is a side view of the structure illustrated in FIG. 12 rotated by 90°.

FIG. 8 shows a single slot 104 having a length L, width W and curved ends. To confine any incident of the above-mentioned accidental dangerous ignition inside the combustion chamber 75, the slots 104 are formed having at least about twice the length L as the width W and are preferably at least about twelve times as long. Length to width (L/W) ratios outside these limits are also effective. We found that slots are more effective in controlling accidental deflagration or detonation ignition than circular holes, although beneficial effect can be observed with L/W ratios in slots as low as about 3. Above L/W ratios of about 15 there can be a disadvantage in that in a plate 90 of thin flexible metal possible distortion of one or more slots 104 may be possible as would tend to allow opening at the center of the slots creating a loss of dimensional control of the width W. However, if temperature and distortion can be controlled then longer slots can be useful; reinforcement of a thin inlet plate by some form of stiffening, such as cross-breaking, can assist adoption of greater L/W ratios. L/W ratios greater than about 15 are otherwise useful to maximize air flow rates and use of a thicker plate material than about 0.5 mm or a more highly tempered grade of steel, stainless steel or other chosen metal, favors a choice of a ratio of about 20 to 30.

To perform their ignition confinement function, it is important that the slots 104 perform in respect of any species of extraneous flammable fumes which may reasonably be expected to be involved in a possible spillage external to the combustion chamber 75 of which the air inlet of the invention forms an integral part or an appendage.

Figure 9:
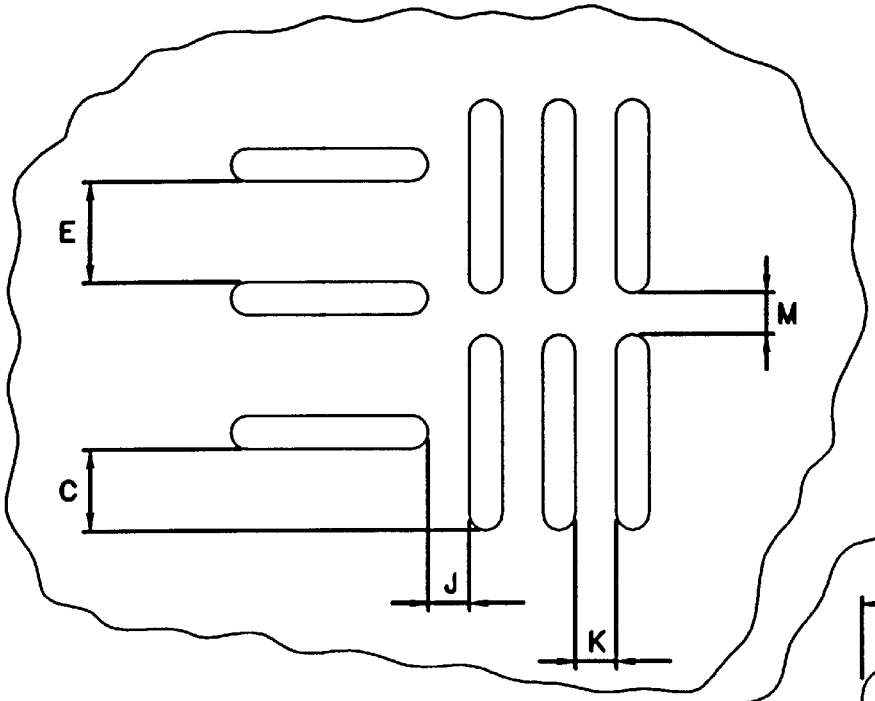
FIG. 9 is a detailed plan view of the spacing of part of the arrangement of ports on the inlet plate of FIG. 7.

FIGS. 8 and 9 show slot and inter-port spacing dimensions adopted in the embodiment depicted in FIG. 7. The dimensions of the ports are the same and have a length L of 6 mm and a width W of 0.5 mm. The ends of each slot are semicircular but more squarely ended slots are suitable. In fact, squarer ended slots appear to promote higher flame lift which tends to keep the plate desirably cooler. The chosen manufacturing process can influence the actual plan view shape of the slot. Metal blanking such large numbers of holes can be difficult as regards maintaining such small punches if the comer radii are not well rounded. The photochemical machining process of manufacture of plates 90 with slots 104 is also more adapted to maintaining round cornered slots.

The interport spacing illustrated in FIG. 9 performs the required confinement function in the previously described situation. The dimensions indicated in FIG. 9 were as follows: C=4.5 mm; E=3.7 mm; J=1.85 mm; K=1.6 mm; M=1.4 mm.

As one example, the inlet plate having the dimensions and spacing of slots as indicated above and the pattern shown in FIG. 7, during one testing procedure, allowed passage of fumes of spilled gasoline through the inlet plate 90 where they ignited inside the combustion chamber 75 and burned vapor until 1 U.S. gallon was consumed. This was done without the temperature of the inlet plate 90 in the region of the edge slots 107 or unperforated border 101 increasing to the point of igniting fumes which had not yet passed through the inlet plate, the test concluding when no more gasoline vapor remained to be consumed after more than one hour of continuous burning on the plate 90.

Referring to FIGS. 10–13, they collectively show fuel supply line 210 and pilot fuel line 470 extending outwardly from a plate 250. Plate 250 is removably sealable to skirt 600 that forms the side wall of the combustion chamber. Plate 250 is held into position by a pair of screws 620 or by any other suitable means. Pilot fuel line 470 and fuel supply line 210 pass through plate 250 in a substantially fixed and sealed condition. Sheath 520 also extends through plate 250 in a substantially fixed and sealed condition as does igniter line 640. Igniter line 640 connects on one end to an igniter button 220 and a piezo igniter 660 on its other end. Igniter button 220 can be obtained from Channel Products, for example. Each of pilot fuel supply line 470, fuel supply line 210 and sheath 520 are removably connectable to gas control valve 69 by compression nuts. Each of the compression nuts are threaded and threadingly engage control valve 69.

Sheath 520, preferably made of copper, contains wires (not shown) from thermocouple 80 to ensure that, in the absence of a flame at pilot burner 73, gas control valve 69 shuts off the gas supply. Thermocouple 80 may be selected from those known in the art. Robertshaw Model No. TS 750U is preferred. Sheath 520 also contains a sensor 530 located below pilot burner 73 and above flame trap 30. Sensor 530 is positioned to detect flames on or in the vicinity of flame trap 30 and, in such a case, signals gas control valve 69 to shut off fuel to pilot burner 73 and main burner 74.

Thermocouple 80 contains sensor 530, also known as a temperature sensitive switch, which is designed to disable gas valve 69 in the event that flammable vapors are being consumed on flame trap 30. Sensor 530 should be located as near to flame trap 30 as possible and activates at a predetermined temperature, preferably between about 400–600° F. Close proximity to flame trap 30 causes sensor 530 to be cooler during normal operation due to the air flow through flame trap 30. Sensor 530 will function quicker due to its proximity to the burner vapors in the event of a flammable vapor incident. Bracket 570 serves the function of correctly locating thermocouple 80 and sensor 530.

The location of thermocouple 80 is important. Quick shutdown of gas valve 69 is desirable for several reasons. Disablement of gas valve 69 results in pilot burner 73 outage and subsequent main burner 74 shutdown. Therefore, main burner 74 cannot be ignited, which may result in the development of undesirable pressure waves within combustion chamber 15 while flammable vapors are being consumed on the flame trap. Flammable vapor spills may result in vapor concentrations that migrate in and out of the flammable range. Vapors adjacent flame trap 30 may ignite and be consumed for a period of time and then self-extinguish due to rich or lean vapor conditions. Disablement of gas valve 69 (i.e. pilot burner 73 and main burner 74 shutdown) removes the water heater as a source of ignition if the vapors should again reach a flammable concentration level.

In addition, sensor 530 serves to notify the homeowner that a situation has occurred that requires immediate attention and inspection. Since many flammable vapor incidents may go undetected, it is important to shut down the water heater permanently after such a situation has occurred. This sensor 530 may also activate in the event of other potentially hazardous conditions such as blocked flue or air inlets. These conditions result in high combustion chamber temperatures which may result in sensor 530 activation and again warn the homeowner that a potentially dangerous situation exists and should be addressed.

As discussed previously, FIGS. 4–6 show a preferred connection between an air inlet plate 90 and lower wall 86 of a combustion chamber 75 to provide a desired heat dissipation effect around the flanges 200 of the air inlet plate 90 which can endow a given inlet with resistance to overheating around the edges. We observed that prolonged combustion of a relatively large quantity of extraneous fumes on the inside surface of the plate 90 (e.g. such as would vaporize from the spill of one US gallon of gasoline) leads to intermittent heating to incandescence over the whole area of various plates 90 tested.

We discovered that heating to incandescence particularly correlates to extraneous fumes to air ratios close to the stoichiometric value for the particular extraneous fumes. This is particularly a problem during extended periods of combustion at air inlet 90. We have further surprisingly discovered that ignition and combustion can still be confined to the combustion chamber despite incandescence with precisely controlled flame trap structures.

Figure 14:
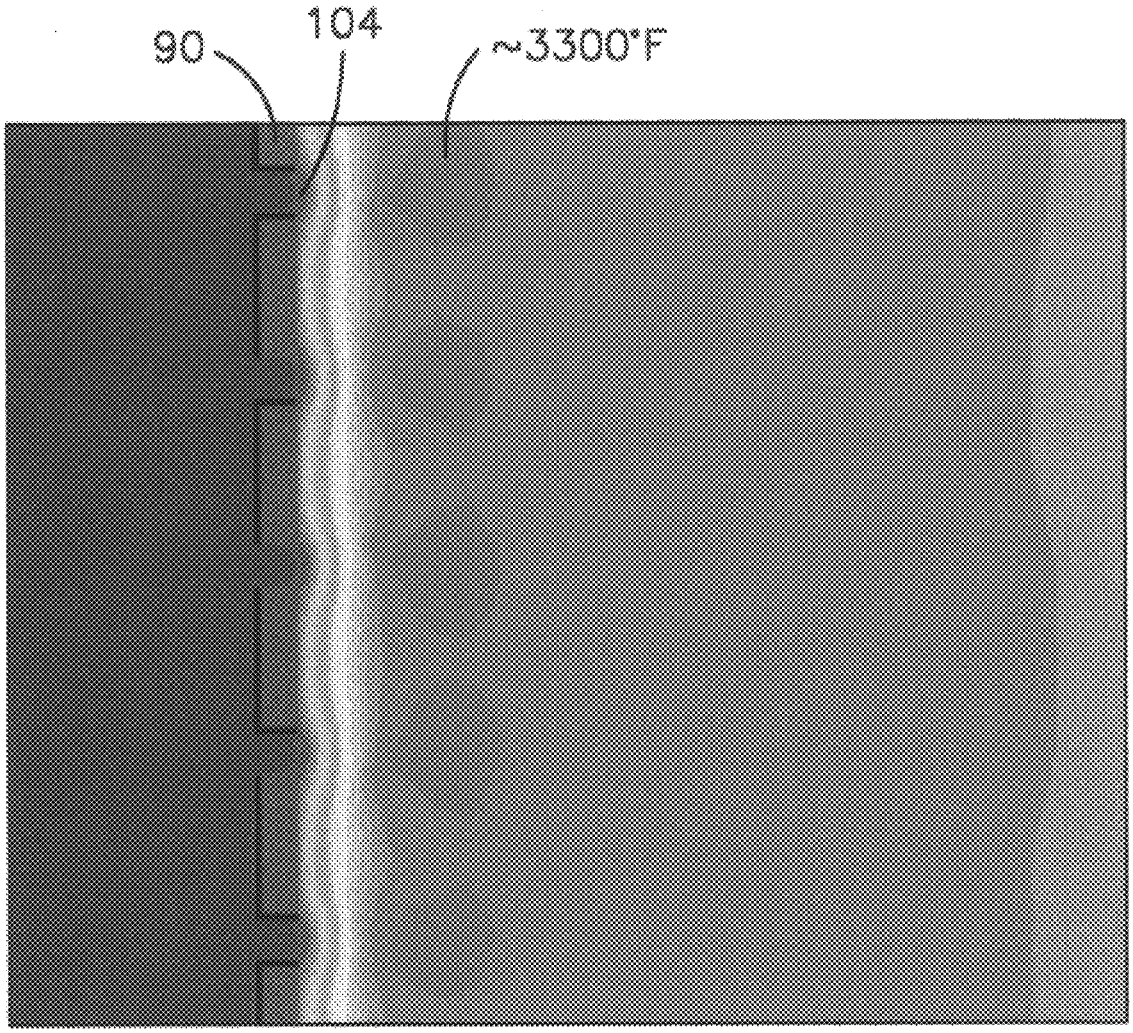
FIG. 14 is a schematic partial cross section of a flame trap showing different temperatures caused by combustion of fumes within a combustion chamber in accordance with aspects of the invention.
Figure 15:
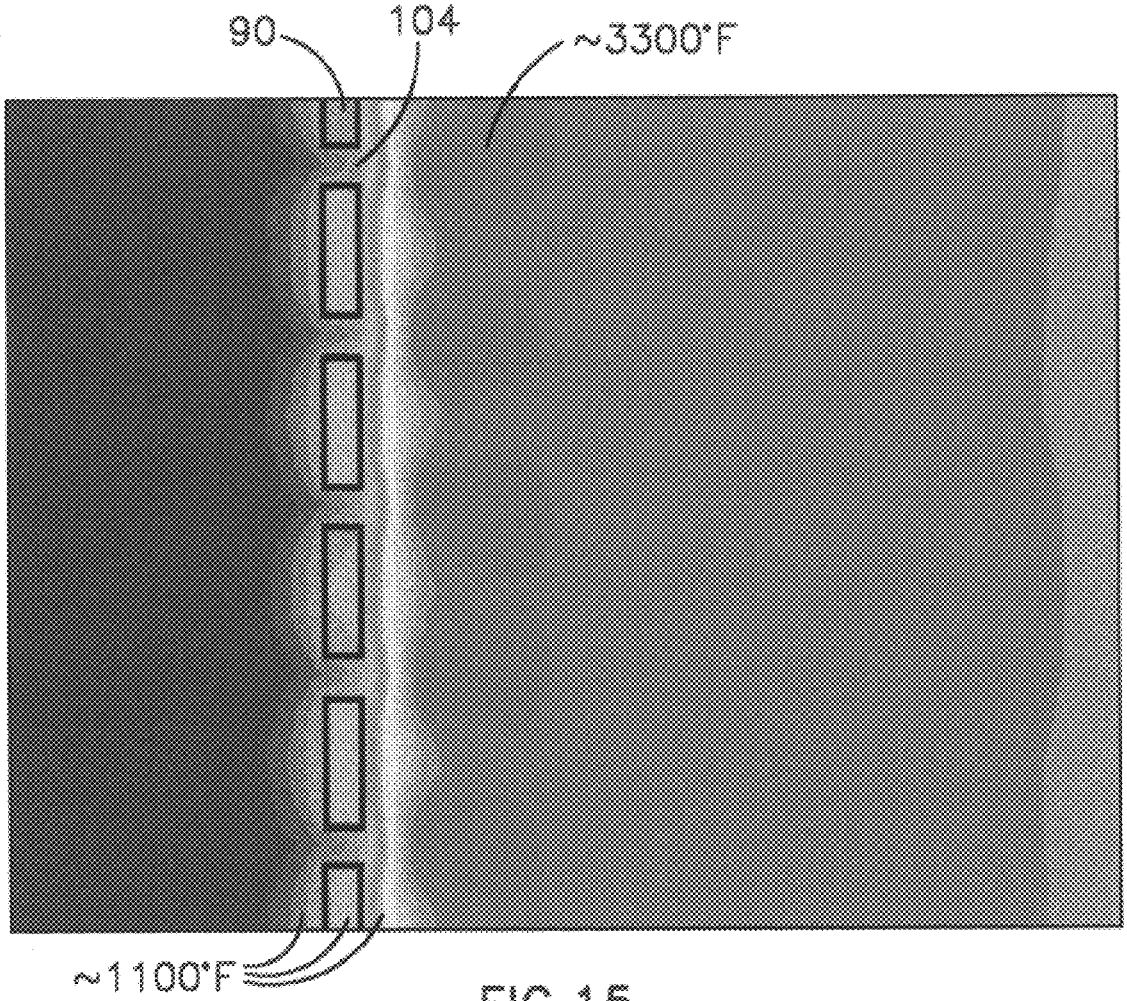
FIG. 15 is similar to FIG. 14 except that the temperatures are taken later in the combustion event.
Figure 16:
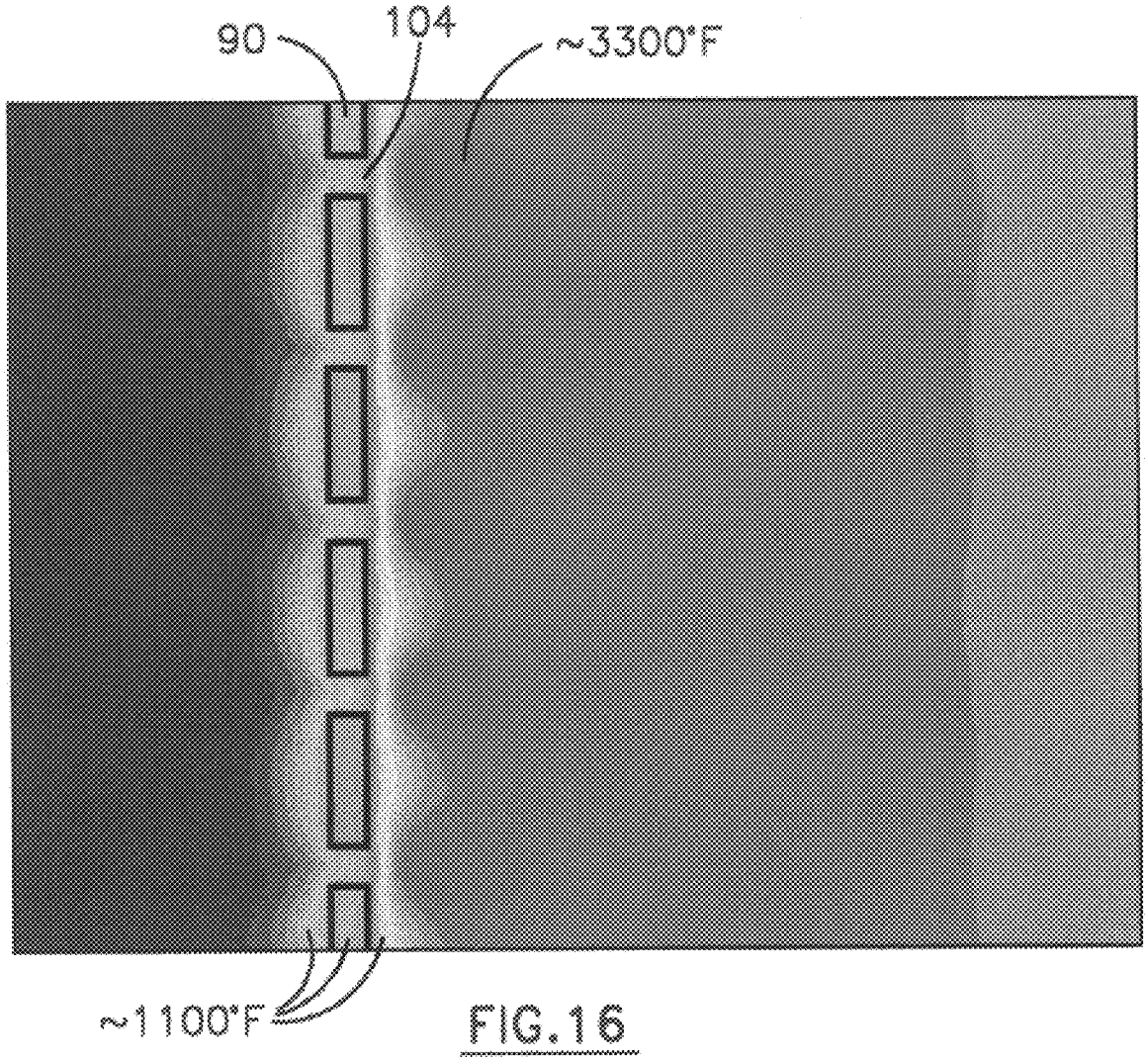
FIG. 16 is similar to FIG. 15 except that the temperatures are taken still later in the combustion event.

Referring to FIGS. 14–16, it can be seen that the air inlet 90 becomes hotter over the course of a combustion event. As shown, flame temperatures are about 3300° F., which can lead to air inlet temperatures of about 1100° F., for example. This high temperature includes the surface of the air inlet on the outside of the combustion chamber. This is important in that the ignition temperature of many extraneous fumes is far below 1100° F. One example is butane. It has an ignition temperature of about 890° F. Hence, it would be expected that the 1100° F. air inlet temperature would cause ignition outside of the combustion chamber. Experimentation proved this to be correct unless a particular structure was present.

We discovered that the temperatures are not the only critical variable. The velocity of the fumes and air mixture is an important variable. Specifically, the velocity of fumes passing through the air inlet, especially at or near stoichiometric conditions, should be kept higher than the flame velocity of the extraneous fumes. This prevents the combustion reaction from occurring until after the fumes have passed into the combustion chamber.

Figure 17:
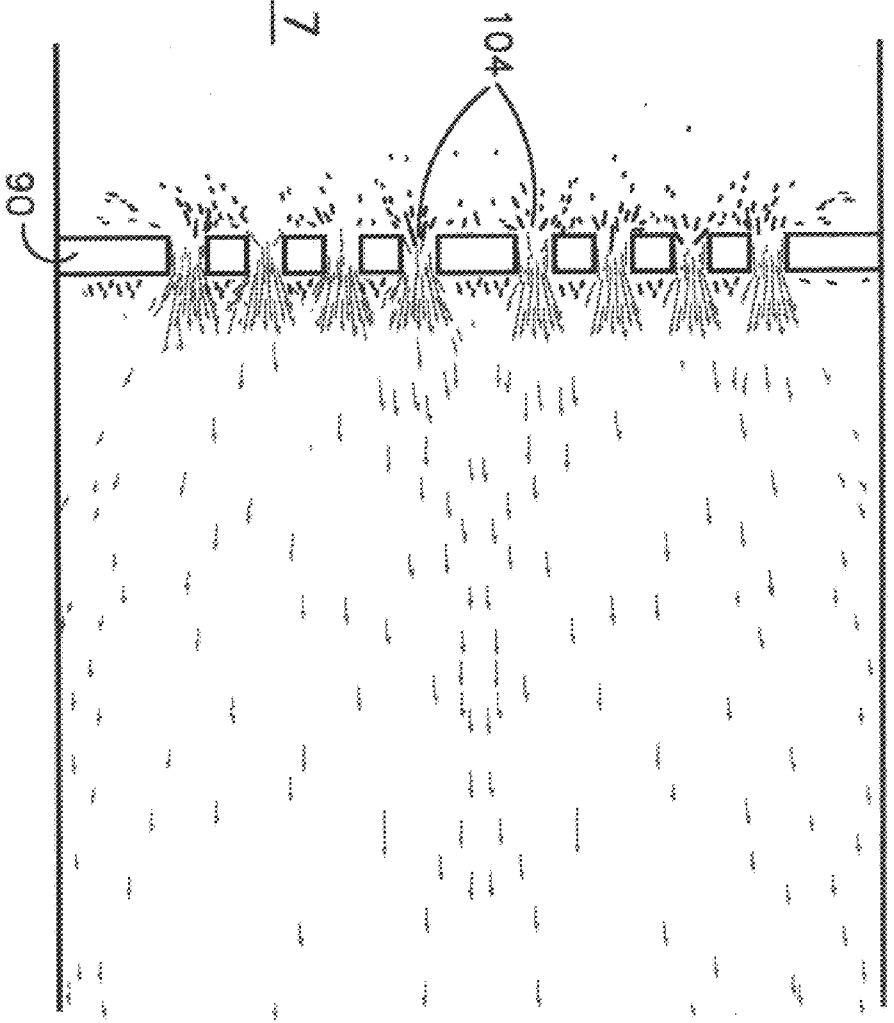
FIG. 17 is a schematic partial cross section of a flame trap showing extraneous fumes and air velocities.

Each type of extraneous fume has a flame velocity, i.e. the speed at which a flame moves upon combustion of that particular fume. Butane, which is a particularly troublesome extraneous fume, has a flame velocity of about 2.8 ft/sec. Thus, the air inlet should be designed to have ports that tend to cause butane, for example, to pass through the air inlet at a velocity higher than about 2.8 ft/sec. FIG. 17 shows this as part of the invention wherein the fumes pass through the ports at greater than about 2.8 ft/sec. The darker arrows depict velocities above about 2.8 ft/sec and the light arrows depict velocities at up to about 6 ft/sec or more. A velocity of at least about 3 ft/sec is preferred. A velocity of at least about 4 ft/sec is especially preferred.

It is also possible that the fumes velocity can be less than the flame velocity for a brief period of time and under certain conditions. This situation can occur when the water heater is in stand by mode and there is little, if any, air flow through the air inlet. The initial passage of fumes and air through the air inlet would typically be less than flame velocity. However, the air inlet is cool at that point and stays cool upon initial ignition of the fumes in the combustion chamber. It is not important that the fumes velocity be greater than 2.8 ft/sec at that point.

As the fumes burn, the velocity increases somewhat as the natural draft increases. Only at the time that the air inlet begins to reach the ignition temperature of the fumes is it important that the fumes velocity exceed the flame velocity of the fumes. This typically occurs after the combustion event has been ongoing for about 30 seconds.

The size and shape of the ports causes the fumes velocity to exceed the flame velocity. The particular embodiment of air inlet 90 and ports/slots 104 shown and described herein is one example of an air inlet that does result in the appropriate fumes velocity. Of course, other air inlets having the properly shaped and sized ports may be used and are clearly within the scope of this invention. Such ports prevent stagnation of the fumes adjacent the air inlet outside the combustion chamber, thereby confining ignition and combustion within the combustion chamber.

It is to be understood that the invention disclosed and defined herein extends to all alternative combinations of the individual features mentioned or evident from the text or drawings. All of these different combinations constitute various alternative aspects of the invention.

The foregoing describes embodiments of the present invention and modifications, obvious to those skilled in the art can be made to them, without departing from the scope of the present invention.

What is claimed is:

1. A water heater comprising:

a water container;

a combustion chamber adjacent the container, said combustion chamber having at least one flame trap to admit air and extraneous fumes into said combustion chamber;

said flame trap having a plurality of ports, each port being sized and shaped to cause air and extraneous fumes to pass through said ports at a velocity higher than the flame velocity of said extraneous fumes to confine ignition and combustion of said extraneous fumes within said combustion chamber; and a burner associated with said combustion chamber and arranged to combust fuel to heat water in said container.

2. The water heater as claimed in claim 1, wherein said velocity of said extraneous fumes and air passing through said ports is sufficiently high to cause the temperature of said air and extraneous fumes to remain below their ignition temperature.

3. The water heater as claimed in claim 1, wherein said velocity of said extraneous fumes and air is greater than about 2.8 ft/sec.

4. The water heater as claimed in claim 1, wherein said velocity of said extraneous fumes and air prevents stagnation of extraneous fumes and air adjacent said flame trap and outside of said combustion chamber.

5. The water heater as claimed in claim 1, wherein said ports comprise slots.

6. The water heater as claimed in claim 1, wherein said ports are arranged in rows.

7. The water heater as claimed in claim 1, wherein said ports are formed in a metal plate by photochemical machining.

8. The water heater as claimed in claim 1, wherein said water heater further comprises an outlet spaced apart from said flame trap allowing products of combustion to exit said combustion chamber.

9. The water heater as claimed in claim 1, wherein said flame trap comprises a metal plate.

10. The water heater as claimed in claim 1, wherein said flame trap has a heat dissipation region at its periphery.

11. The water heater as claimed in claim 1, wherein the ports are constructed so that in cross section, said ports have substantially parallel sides.

12. The water heater as claimed in claim 1, wherein the ports have a maximum limiting dimension of about 0.7 mm to 0.75 mm.

13. The water heater as claimed in claim 1, wherein the ports are slot shaped and not more than about 0.6 mm wide and spaced apart from each other at least about 1.1 mm.

14. The water heater as claimed in claim 1, wherein the ports are arranged in a pattern comprising solely apertures in the form of aligned and spaced arrays of slots.

15. A water heater comprising:

a water container;

a combustion chamber adjacent the container;

a burner associated with the combustion chamber and arranged to combust fuel to heat water in the container; and a flame trap having a plurality of ports associated with the combustion chamber adapted to admit air and extraneous fumes into the combustion chamber and prevent ignition of remaining extraneous fumes outside of the combustion chamber, said ports adapted to cause said extraneous fumes and air to pass through said flame trap at a velocity sufficiently high to prevent stagnation of said extraneous fumes adjacent said flame trap outside of said combustion chamber, thereby confining ignition and combustion of said extraneous fumes within said combustion chamber.

16. The water heater as claimed in claim 15, wherein said velocity of said extraneous fumes and air is greater than about 2.8 ft/sec.

17. A water heater comprising:

a water container;

a combustion chamber adjacent the container;

a burner associated with the combustion chamber and arranged to combust fuel to heat water in the container; and a flame trap associated with the combustion chamber adapted to admit air and extraneous fumes into the combustion chamber and prevent ignition of remaining extraneous fumes outside of the combustion chamber, said flame trap having ports adapted to cause said extraneous fumes and air to pass through said flame trap at a velocity sufficiently high to prevent said extraneous fumes from reaching their ignition temperature outside of said combustion chamber, thereby confining ignition and combustion of said extraneous fumes within said combustion chamber.

18. The water heater as claimed in claim 17, wherein said velocity of said extraneous fumes and air is greater than about 2.8 ft/sec.

19. The water heater as claimed in claim 18, wherein said ports comprise slots.

20. A water heater comprising:

a water container;

a combustion chamber adjacent the container, said combustion chamber having at least one flame trap having a heat dissipation region at its periphery to admit air and extraneous fumes into said combustion chamber;

said flame trap having a plurality of ports, each port being sized and shaped to cause air and extraneous fumes to pass through said ports at a velocity higher than the flame velocity of said extraneous fumes to confine ignition and combustion of said extraneous fumes within said combustion chamber, wherein the heat dissipation region comprises a metal-to-metal overlap portion between a peripheral edge of a plate forming said flame trap and a peripheral edge of an opening in the combustion chamber; and a burner associated with said combustion chamber and arranged to combust fuel to heat water in said container.

* * * * *